US005203909A

United States Patent [19]

Petrushka et al.

[11] Patent Number: 5,203,909

[45] Date of Patent: Apr. 20, 1993

[54] METHOD AND APPARATUS FOR SLAG FREE CASTING

[75] Inventors: Robert G. Petrushka, Brecksville; Franklin E. Rote, Bay Village, both of Ohio

[73] Assignee: LTV Steel Company, Inc., Cleveland, Ohio

[21] Appl. No.: 776,981

[22] Filed: Oct. 15, 1991

[51] Int. Cl.[5] ..... B22D 41/58

[52] U.S. Cl. ..... 75/375; 266/90; 266/236; 266/227

[58] Field of Search ..... 75/375; 266/45, 220, 266/227, 230, 236, 78, 90; 222/603, 606, 590

[56] References Cited

U.S. PATENT DOCUMENTS

| | | | |
|---|---|---|---|
| 589,210 | 8/1897 | Hall | 266/227 |
| 1,328,803 | 1/1920 | Bagley | 266/227 |
| 2,246,144 | 6/1941 | Perrin | 266/227 |
| 2,828,516 | 4/1958 | Black et al. | 266/230 |
| 3,469,740 | 9/1969 | Crowe | 266/220 |
| 4,079,918 | 3/1978 | Truppe et al. | 266/45 |
| 4,373,705 | 2/1983 | Yamada | 266/227 |
| 4,382,582 | 5/1983 | Seki | 266/45 |
| 4,431,169 | 2/1984 | Fuzii et al. | 266/236 |
| 4,462,572 | 7/1984 | Keenan et al. | 266/230 |
| 4,706,944 | 11/1987 | Lee | 266/272 |
| 4,767,036 | 8/1988 | Schleimer et al. | 222/603 |
| 4,840,355 | 6/1989 | LaBate | 266/220 |
| 4,909,421 | 3/1990 | Daussan et al. | 222/590 |

*Primary Examiner*—Scott Kastler

*Attorney, Agent, or Firm*—Watts, Hoffmann, Fisher & Heinke Co.

[57] ABSTRACT

The present invention provides a new and improved method and apparatus for tapping molten metal through the tap hole of a metallurgical vessel. The apparatus utilizes a ladle or a BOF furnace or other metallurgical vessel used for the containment of molten metal. At least one extension drive mechanism is attached to the support structure to position the distal end of a lance within the vessel a predetermined distance above the surface of its contents. The lance is connected to an inert gas source such as Argon. Once the lance is properly positioned, the inert gas is directed onto the surface of the molten metal to prevent the slag from entering the tap hole. An alignment drive can also be attached to the support structure to adjust the position of the extension drive relative to the vessel so that the lance may be properly positioned within the vessel above the tap hole. The extension and alignment drives are operatively controlled by a computerized controller which interfaces with the sensors to monitor the physical characteristics of the vessel. The controller operatively controls the drives to position the lance a predetermined distance above the tap hole of the vessel.

28 Claims, 6 Drawing Sheets 26
32
24
18
2
20
20
4
28
6,8
6,8
36
38
40
22
CONTROLLER

METHOD AND APPARATUS FOR SLAG FREE CASTING

The present invention relates generally to the tapping of molten metal from metallurgical vessels and in particular to a method and apparatus for impeding slag floating on the surface of a molten metal bath within the vessel from being entrained with the molten metal as it is tapped from the vessel.

BACKGROUND ART

Persons skilled in the art of tapping metal know that it is desirable and advantageous to separate the molten metal bath from the slag floating on the surface of the bath to obtain clean, slag-free metals. To accomplish this task, various apparatus and methods for impeding slag from entering the tap hole of a metallurgical vessel during the tapping process have been proposed.

One early 19th century smelting and refining furnace, described in U.S. Pat. No. 589,210, purports to remove slag from the surface of the molten metal bath by constantly blowing a stream of air across the surface of the bath.

The furnace consists of two successive adjacent chambers, the first chamber being lightly sloped towards the second chamber. The second chamber is positioned adjacent the first chamber at a lower elevation. A wall having a discharge opening separates the chambers. Or is smelted within the first chamber. The matte which results from the smelting sinks to the bottom of the first chamber and the slag floats atop the matte. When the volume of matte within the first chamber rises to the level of the discharge opening, the stream of air forces the surface slag through the discharge opening into the second chamber. The molten metal or matte is then drawn off through a bottom tap hole. Unfortunately, this apparatus does not prevent the remaining slag from being drawn into the molten metal stream.

Another early method of preventing slag from flowing through the tap hole of an Open Hearth type furnace is shown in U.S. Pat. No. 2,246,144. Here a raft is proposed which floats on the bath above a tap hole located in the bottom side of the furnace. As the molten metal drains through the tap hole of the furnace, a vortex forms in the bath. The raft is purportedly positioned over the vortex and allowed to descend with the bath as the molten metal pours through the tap hole, thereby impeding the entrainment of the slag into the vortex. The raft is adjustably positioned on the bath surface by a boom which extends through an opening in the vessel. The boom is adjustably secured to a movable cart on the outside of the vessel. The design of many modern vessels makes the use of this apparatus and method unfeasible.

Other apparatus have been suggested to impede slag from mixing with the flow of molten metal in a top pour ladle by directing hot gas streams onto the bath surface to prevent slag from entering the ladle spout. In a top pour ladle, the ladle is tilted until the molten metal pours over the lip or spout, much like the common soup ladle. U.S. Pat. No. 2,828,516 shows a spout design having a dam-like partition which holds back the slag atop the pool of molten metal directly adjacent to the spout. In addition, hot gas is directed onto the surface of the pool to force the slag away from the spout to allow the bath to flow cleanly from the spout. After a majority of the bath is poured from the ladle, the ladle is tilted in the opposite direction so that the remaining metal and slag can be poured through a slag outlet. Top pour ladles, however, are rarely used in contemporary mill operations such as continuous cast operations where bottom pour vessels are used in the casting process to fill tundishes which in turn drain into the continuous casting mold. One reason for this is the inherent limitation of the extent to which such a vessel may be tilted. Another reason is that contemporary continuous cast operations generally utilize bottom pour vessels.

Floating ceramic bodies and stoppers which plug the tap hole once the bath volume within the vessel has been substantially tapped have also been proposed (See U.S. Pat. Nos. 4,431,169; 4,462,574; 4,706,944). The floating bodies, which weigh more than the slag but less than molten metal, are placed within a vessel. The stoppers are generally attached to the end of a rod which is positioned above the tap hole of the vessel. When the bath has substantially drained from the ladle, the bodies and/or stoppers are used to plug the tap hole to prevent slag from flowing through the tap hole. These methods, however, do not prevent slag from being entrained in the vortex created by the flow of metal through the tap hole. Moreover, the bodies and stoppers are generally unreliable and are consumed during a heat due to the extreme heat of the bath. The bodies and stoppers are also expensive to replace.

Still another proposed apparatus and method to separate molten metal from slag during the tapping process includes a least one gas permeable refractory element located in the vessel adjacent the tap hole (See U.S. Pat. Nos. 4,079,918; 4,360,190). A gas jet is introduced into the bath through the element in the area where the vortex would be formed. The gas intersects the vortex area, purportedly restraining the slag from being entrained in the tapping process.

Lastly, another method and apparatus purports to promote slag free tapping of metal from a Basic Oxygen Furnace (BOF). Generally, BOFs' have a tap hole in an upper side wall section. Tapping is accomplished by tipping the vessel so that the molten metal flows through the tap hole. The apparatus includes a plurality of refractory devices arranged around the tap hole. When the BOF attitude is modified for tapping, i.e. tipped, jets of gas are discharged through the refractory devices into the bath. The gas jets purportedly move the slag away from the area of the molten metal above the tap hole so that the slag free metal is tapped. Unfortunately, the refractory devices are fixed and cannot be adjusted to maximize each jet's potential for impeding slag from entering into the tap hole.

None of the methods heretofore proposed have proved to be completely successful in eliminating the inclusion of slag in the molten metal during tapping, particularly in vessels which have a moving level of molten metal such as those commonly used in contemporary melting operations.

DISCLOSURE OF THE INVENTION

The present invention provides a new and improved method and apparatus for tapping molten metal through the tap hole of a metallurgical vessel. The apparatus utilizes a ladle or a BOF furnace or other metallurgical vessel used for the containment of molten metal.

The vessel is supported by a support structure having sensors which operatively monitor the physical characteristics, i.e. weight, volume or attitude, etc. of the vessel. As used herein the term "vessel" will include, as the context indicates, the contents of the vessel as well as the vessel itself. At least one extension drive mechanism is attached to the support structure to position the distal end of a lance within the vessel a predetermined distance above the surface of its contents. Depending on the type of vessel used, an alignment drive can be attached to the support structure to adjust the position of the extension drive relative to the vessel so that the lance may be properly positioned within the vessel above the tap hole.

The extension drives are operatively controlled by a computerized controller, such as a commercially available Programmable Logic Controller. The controller interfaces with the sensors to receive sensor signals representative of the physical characteristics of the vessel. The controller emits signals in response to the sensed vessel physical characteristics which signals operatively control the extension drive to position the lance a predetermined distance above the tap hole of the vessel.

In embodiments utilizing an alignment drive, the tapping process is initiated by altering the attitude of the vessel so that the bath flows through the tap hole. As the vessel attitude is being adjusted, the controller emits signals representative of the changing vessel attitude to operatively drive the alignment drive to position the extension drive so that the extension drive is positioned to place the distal end of the lance within the vessel a predetermined distance above the molten metal bath surface.

Embodiments not utilizing an alignment drive or attitude adjustment to regulate the tapping process generally include a tap hole control valve such as a linear or rotary slide gate valve to regulate the tapping process. In these embodiments, the tap hole control valve is controlled by the computerized controller in response to the signals representative of the sensed physical characteristics, i.e. the vessel weight, to regulate the tapping process.

Lastly, a substantially non-reactive gas source is connected to the lance, such as CO2, Argon or even air. Typically, the use of inert gases, such as Argon, will be preferred in ladle embodiments, whereas air is preferred in BOF embodiments since the bath will already be saturated with oxygen at the time of tapping. Additionally, a cost savings is realized by utilizing shop air instead of expensive non-reactive gas.

The lance includes a gas control valve which is interfaced to the controller and operated in response to the sensed physical characteristics of the vessel. The controller opens the valve to direct a gas stream upon the bath surface in sufficient volume and at sufficient velocity to force the slag away from the bath vortex during the tapping process. When the volume of the bath falls to a predetermined level, the controller operates the slide gate valve to close the tap hole and the gas control valve in a synchronous order to complete the tapping process. In vessels wherein the tap process is regulated by an attitude adjustment to the vessel such as a BOF, the controller closes the gas control valve only after the vessel attitude is such that no molten metal can flow through the tap hole.

BEST MODE FOR CARRYING OUT THE INVENTION

Figure 1:
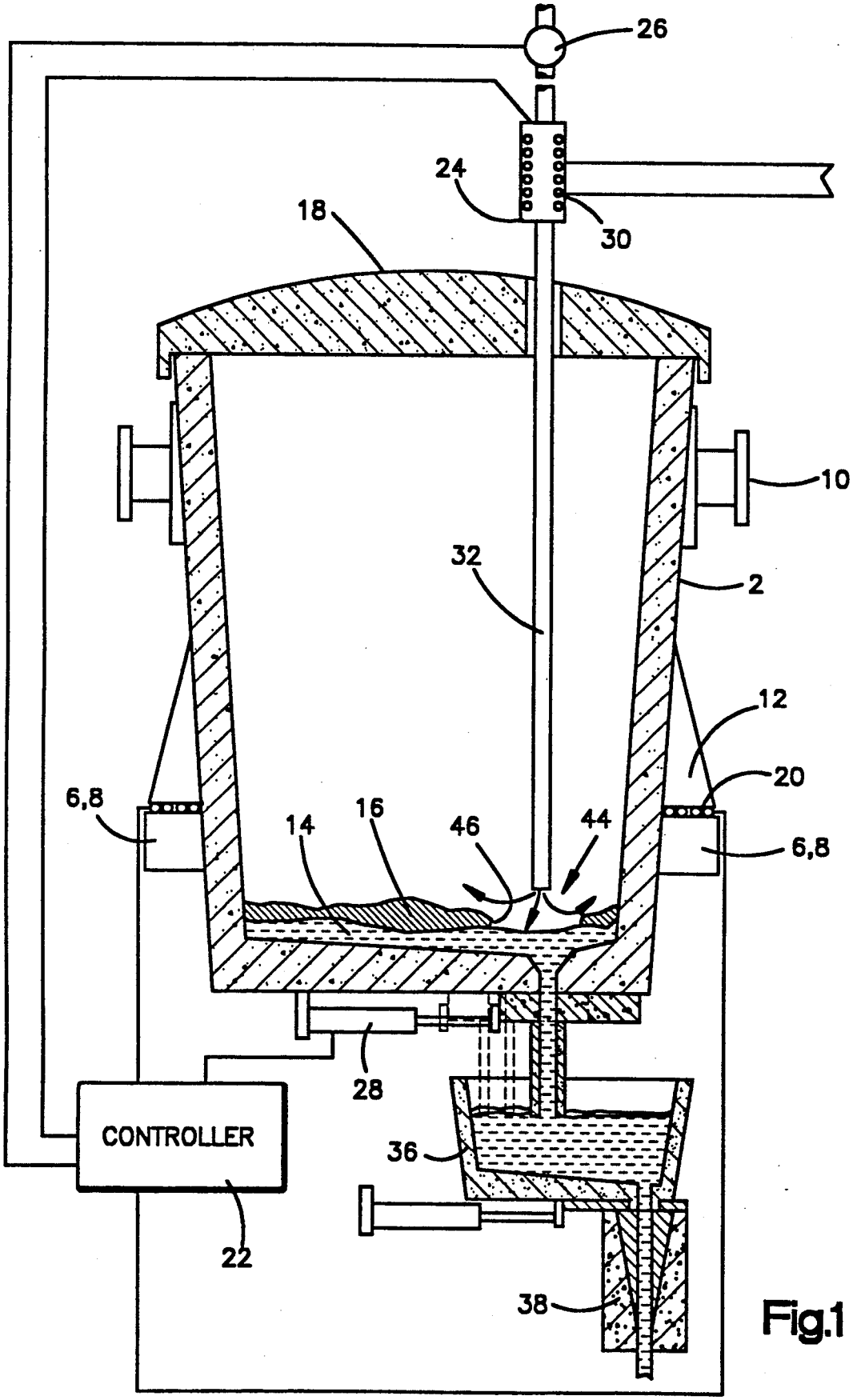
FIG. 1 is a side elevational view of the present invention illustrating a sectional view of a casting ladle positioned upon a continuous casting turret.
Figure 2:
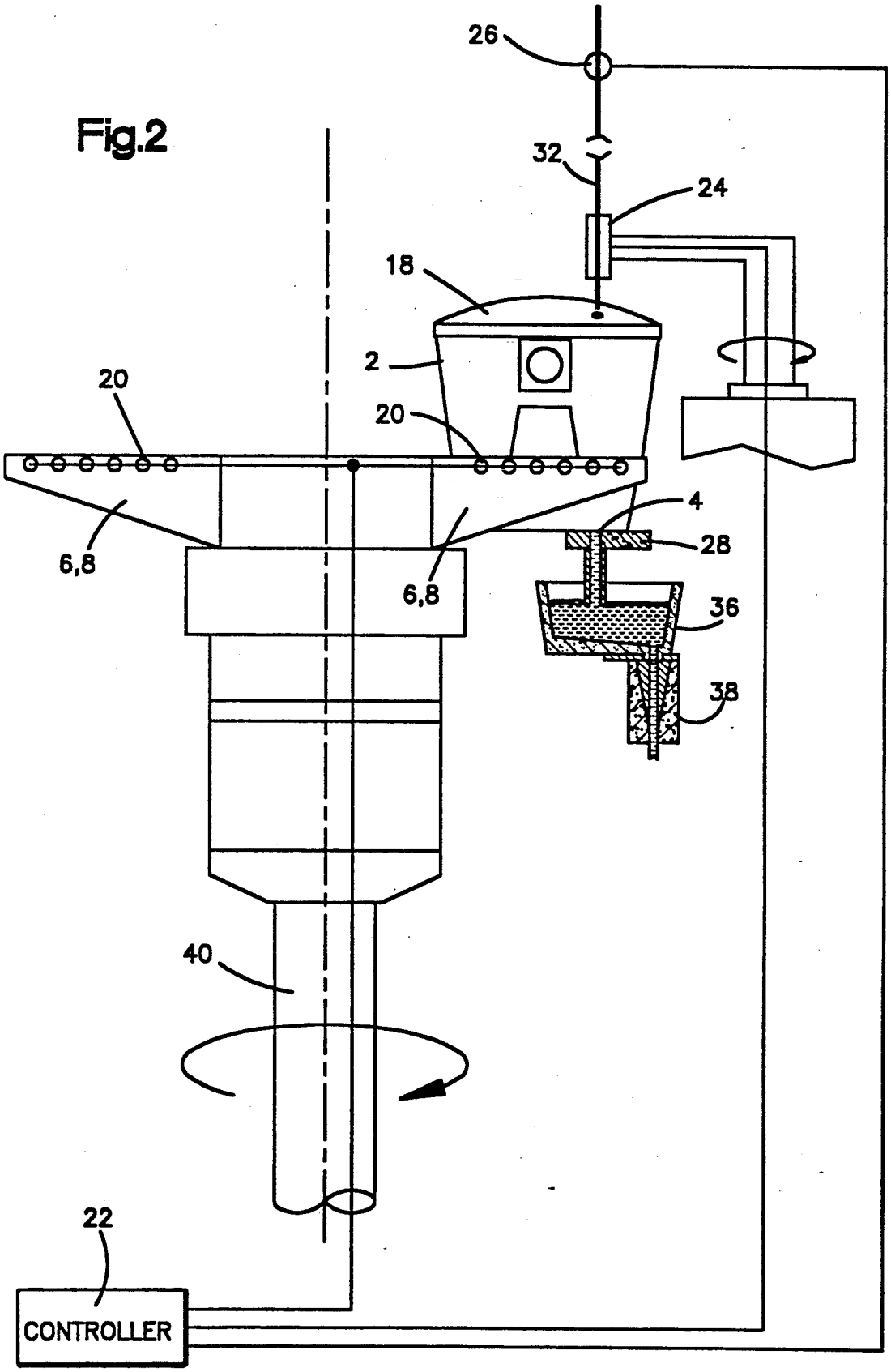
FIG. 2 is a side elevational view of the present invention illustrating a portion of a continuous casting tower showing a ladle mounted upon a turret.
Figure 6:
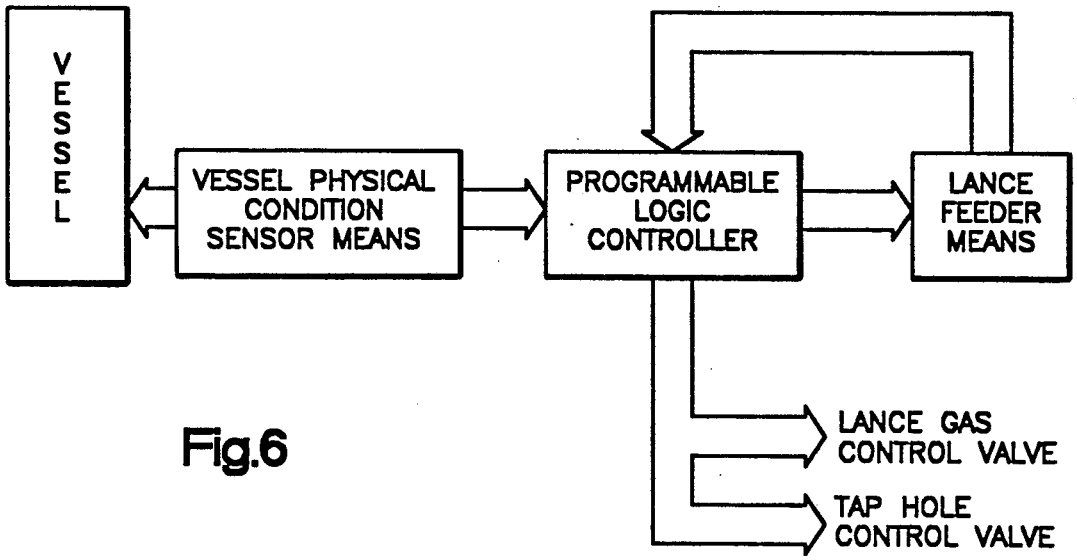
FIG. 6 is a schematic diagram illustrating the control loop within a ladle oriented system.
Figure 7:
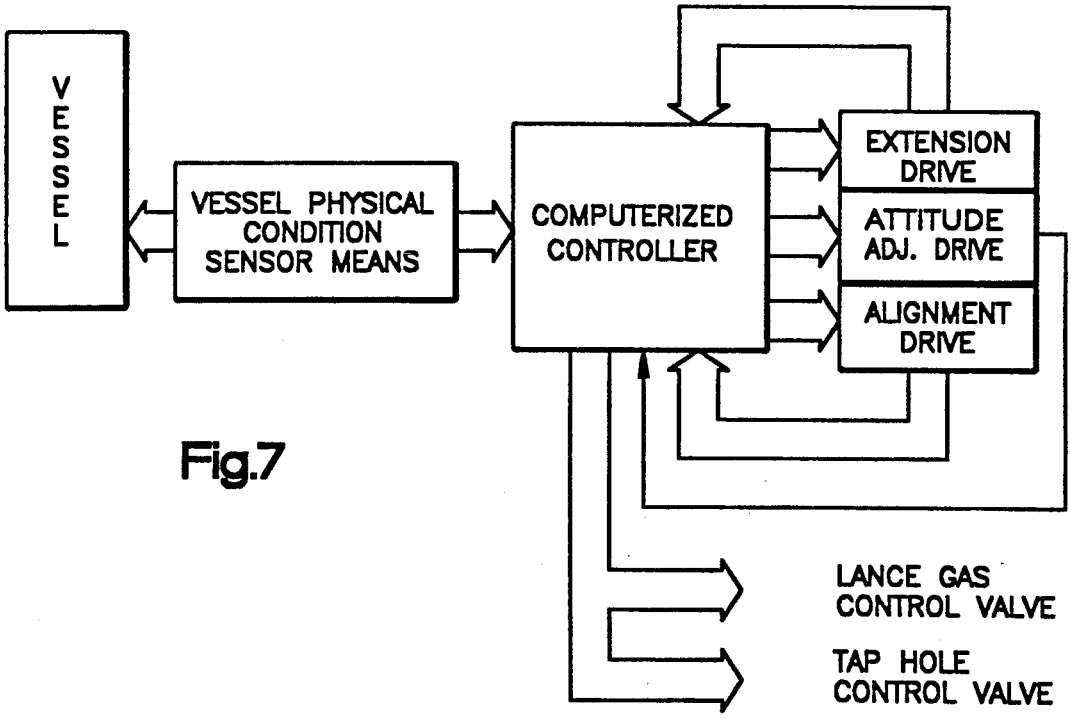
FIG. 7 is a schematic diagram illustrating the control loop within a Basic Oxygen Furnace oriented system.

Referring now to FIGS. 1, 2 and 6, one preferred embodiment of the present apparatus for slag free tapping of molten metal is disclosed. A metallurgical vessel 2 having a tap hole 4, herein shown as a bottom pour ladle generally used in continuous casting processes, is mounted upon a support structure 6, herein disclosed as the arms 8 of a continuous casting turret although other support structure may be employed without departing from the scope of the invention. A pair of flanged, pivotable trunnions 10 are integrally formed on the exterior of the vessel 2 to allow the tipping of the vessel, if desired. Additional a pair of support braces 12 are secured to the exterior of the vessel to support the vessel 2 when it is positioned atop the arms 8 of a casting turret.

The vessel 2, in an operative state, contains a molten metal bath 14 having a slag 16 covered surface. The vessel 2 may include a cover 18 to aid in maintaining the temperature of the bath 14 and to reduce the thermal shock to the brick thus preserving the vessel's refractory brick lining. The cover 18 may be disposed of, if desired, since the slag 16 covering the surface of the bath 14 acts as an insulator which maintains the temperature of the bath 14.

A plurality of sensor means 20, such as load cells, are secured to the support structure 6 to monitor the physical characteristics, i.e. the weight, or volume of the vessel 2 and its contents. A computerized controller 22, such as a commercially available programmable logic controller, is interfaced to the sensor means 20 to monitor the sensed physical characteristics. The controller 22 is also operatively interfaced to an extension drive 24, gas control valve 26, and the tap hole control valve 28—i.e. a slide gate mechanism.

The extension drive 24 is secured to support structure 6 or, alternatively, to the structure of the metallurgical vessel 2, and includes a lance feeder drive mechanism 30 which is operatively actuated by the controller 22. Lance 32 is drivingly secured to drive mechanism 30 so that its distal end is positioned directly over the tap hole 4 and above the vessel 2 rim prior to tapping the molten metal from the vessel 2. The lance 32 is also flexibly interconnected (not shown) to an substantially non-reactive gas source, such as Argon or CO2.

In continuous casting operations after a heat of steel is refined in a steel making furnace the liquid steel is tapped into a refractory-lined steel ladle. Once filled, the ladle 2 is transported to the base of a casting tower 40 (shown-generally in FIG. 2) by a ladle transfer car. Thereafter the ladle is raised by a crane (not shown) and set into the turret arms 8 and then positioned over the tundish 36 which is positioned over the water cooled mold 38. As the ladle positioned over the tundish 36 is being tapped, another ladle is positioned on arms disposed on the opposite side of the turret 40. Once the ladle is fully tapped, the turret rotates 180 degrees to position and tap the full ladle. In this manner, ladles can be tapped in a substantially continuous process.

The ladle generally has an off-center tap hole 4 in its bottom. Once the ladle is positioned on the support structure 6, the load cells 20 begin to send physical characteristics data to the controller 22. Thereafter, an operator initiates tapping by instructing the controller 22 to open the tap hole 4 by operating the slide gate mechanism 28. Additionally, as soon as a ladle is positioned over the tundish for tapping, the controller 22 systematically generates a lance actuation signal in response to the sensed physical characteristics of the vessel 2. The lance actuation signal is transmitted to drive mechanism 30, which in turn, drivingly positions the distal end of the lance 32 in a predetermined position above the slag 16 covered surface of the molten metal bath 14 within vessel 2. The predetermined position is directly related to the weight of the vessel 2. For example, when a ladle is substantially full, the distal end of the lance 32 will be positioned outside the cover 18 opening.

The controller 22 continuously monitors the physical characteristics of the vessel 2. As the bath 14 flows through the tap hole 4, a vortex is formed within the bath 14. Initially, the depth of the bath 14 prevents slag 16 from being entrained in the vortex. However, as the volume of the bath 14 decreases, slag 16 is drawn into the vortex.

To prevent this occurrence, the controller 22 continuously monitors the weight of the vessel 2 throughout the tapping process. When the weight of the vessel 2 indicates a predetermined volume of the bath 14, the controller 22 continuously and systematically generates lance actuation signals which are transmitted to the drive mechanism 30. The drive mechanism 30 responds by operatively positioning the distal end of the lance 32 a predetermined distance above the slag 16 covered surface.

As the drive mechanism 30 positions the lance 32, the controller 22 also continuously generates gas valve control signals, which are received by the gas control valve 26. The gas control valve 26 responds by opening, closing, or adjusting the flow of gas into the lance 32. Typically, valve 26 is maintained in an open orientation from the point just prior to where the slag 16 covered surface is drawn into the vortex. Normally, a non-reactive gas such as Argon or $CO_2$ is employed. Additionally, it is also desirable to introduce coagulants into the gas stream 44, such as pearlite or lime, to promote solidification of the slag 16 covered surface without impairing the temperature of the bath 14. The coagulants act to stiffen the slag 16 to form an opening 46 about the vortex, thereby impeding slag from being entrained in the vortex.

The pressurized gas discharged from the distal end of the lance 32 is projected above the vortex area and onto the slag 16 covered surface of the bath 14 to forcibly restrain the slag 16 from entering the vortex.

When the sensed weight of the vessel 2 indicates that the molten metal bath 14 has been substantially tapped from the vessel 2, the controller 22 concludes the tapping process by closing the tap hole control valve 28 to contain the remaining slag 16 within the vessel. Once the tap hole control valve 28 is closed, the controller 22 issues the appropriate signals to close the gas control valve 26 and to the lance feeder drive mechanism 30 to return the distal end of the lance 32 to its initial pre-tapping position above the vessel 2 rim.

Another preferred embodiment illustrating the present tapping apparatus and method, as applied to steel making furnaces such as the Basic Oxygen Furnaces (BOF), is disclosed in FIGS. 3–5 and 7. For simplicity, the reference numerals corresponding to the aforementioned embodiment will be referenced by a '. New features, unique to this embodiment, will be represented as 300 series numbers.

A BOF vessel 2' having a tap hole 4' is secured to a trunnioned support structure 6' having sensor means 20' to monitor the physical characteristics, i.e. the attitude of the vessel 2'. The support structure 6' includes an attitude adjustment mechanism to manipulate and adjust the angle of inclination or attitude of vessel 2'. Each vessel 2' can be tilted forwardly or backwardly by the vessel operator, as necessary, by motors operated from a pulpit or platform adjacent the vessel 2'.

A controller 22' is interfaced to the sensing means 20 an alignment drive 304, and an extension drive 24'. The sensing means 20' monitors the attitude of the vessel 2' and emits signals representative of the same to the controller 22'. Once a heat is refined and the molten steel bath 14' within the vessel 2' is ready for tapping, the tapping process is commenced.

Figure 4:
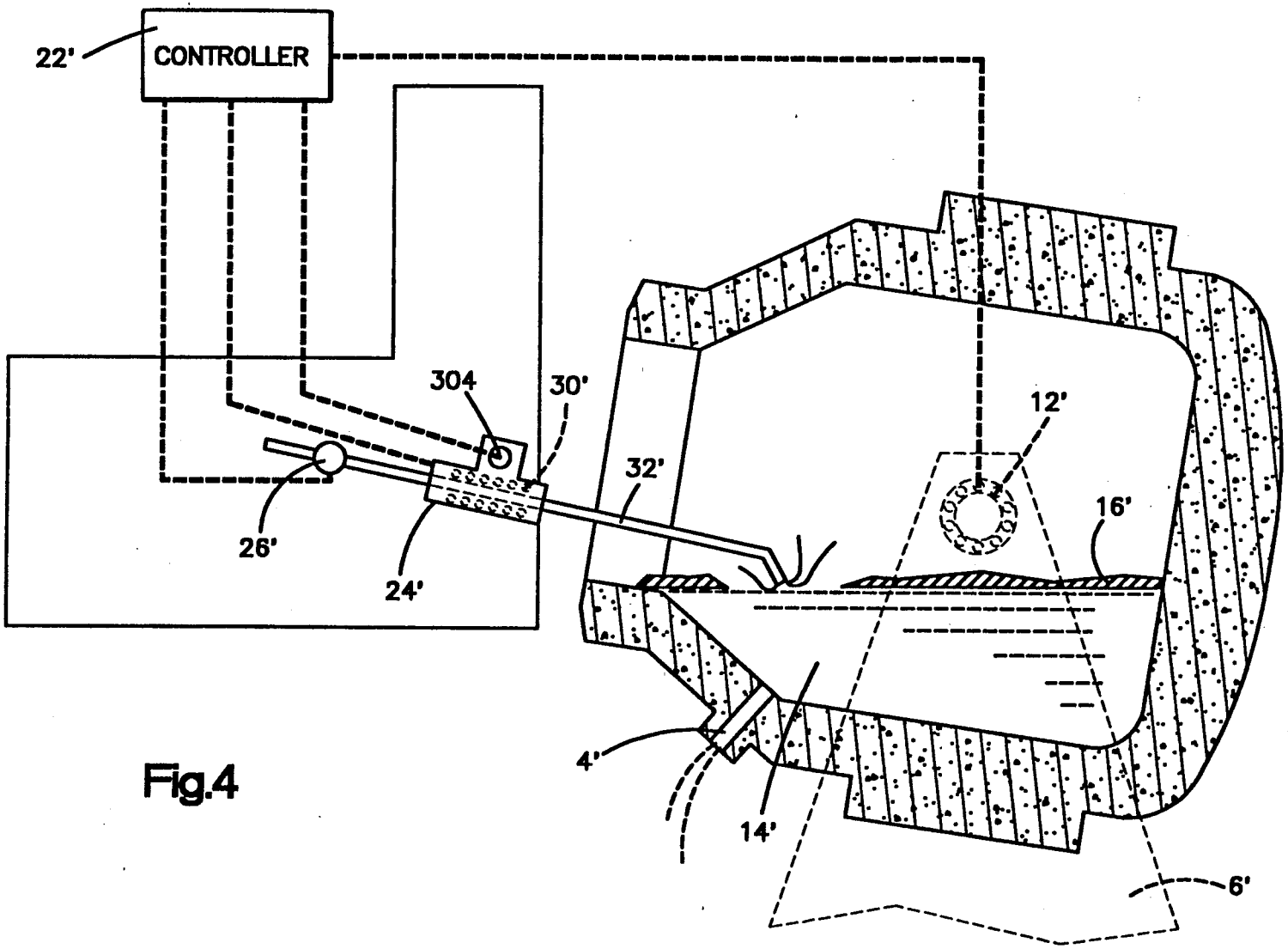
FIG. 4 is a side elevational view of the present invention as applied to a BOF apparatus in a first tapping orientation.

The furnace operator activates an attitude adjustment mechanism to tilt the vessel 2' so that the bath 14' is tapped as in FIG. 4. As the degree of the vessel 2' tilt changes, the sensing means 20' continuously transmits signals representative of the changing attitude to the controller 22'. The controller 22' responds by emitting signals which operatively drive the alignment drive mechanism 304 to position the extension drive 24' adjacent the vessel 2' rim. Thereafter, the controller 22' systematically generates a lance actuation signal which is received by the lance feeder drive mechanism 30', to drivingly position the distal end of the lance 32' above the slag covered surface 16' of the molten metal bath 14'.

Figure 3:
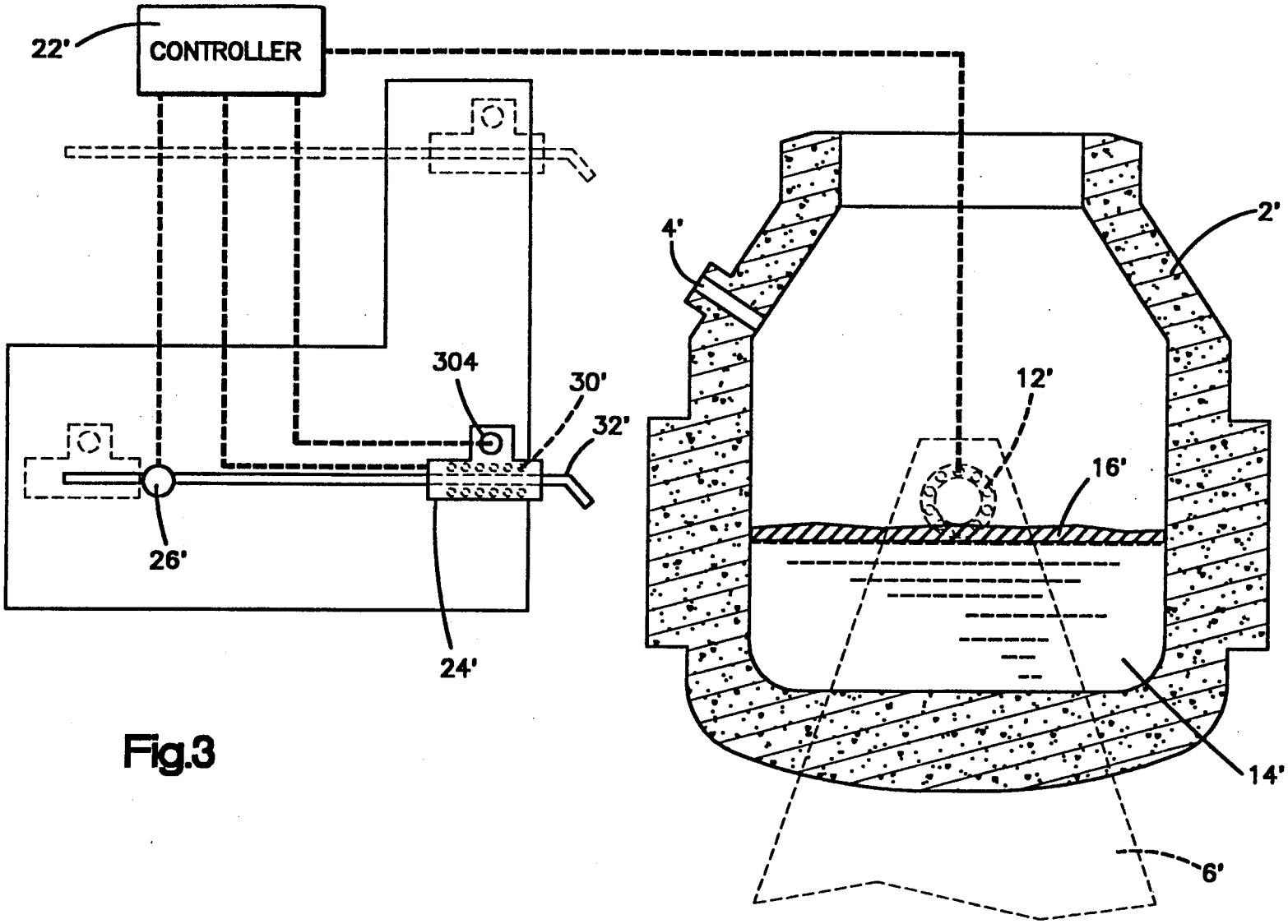
FIG. 3 is a side elevational view of the present invention in an inactive state as applied to a BOF apparatus.
Figure 5:
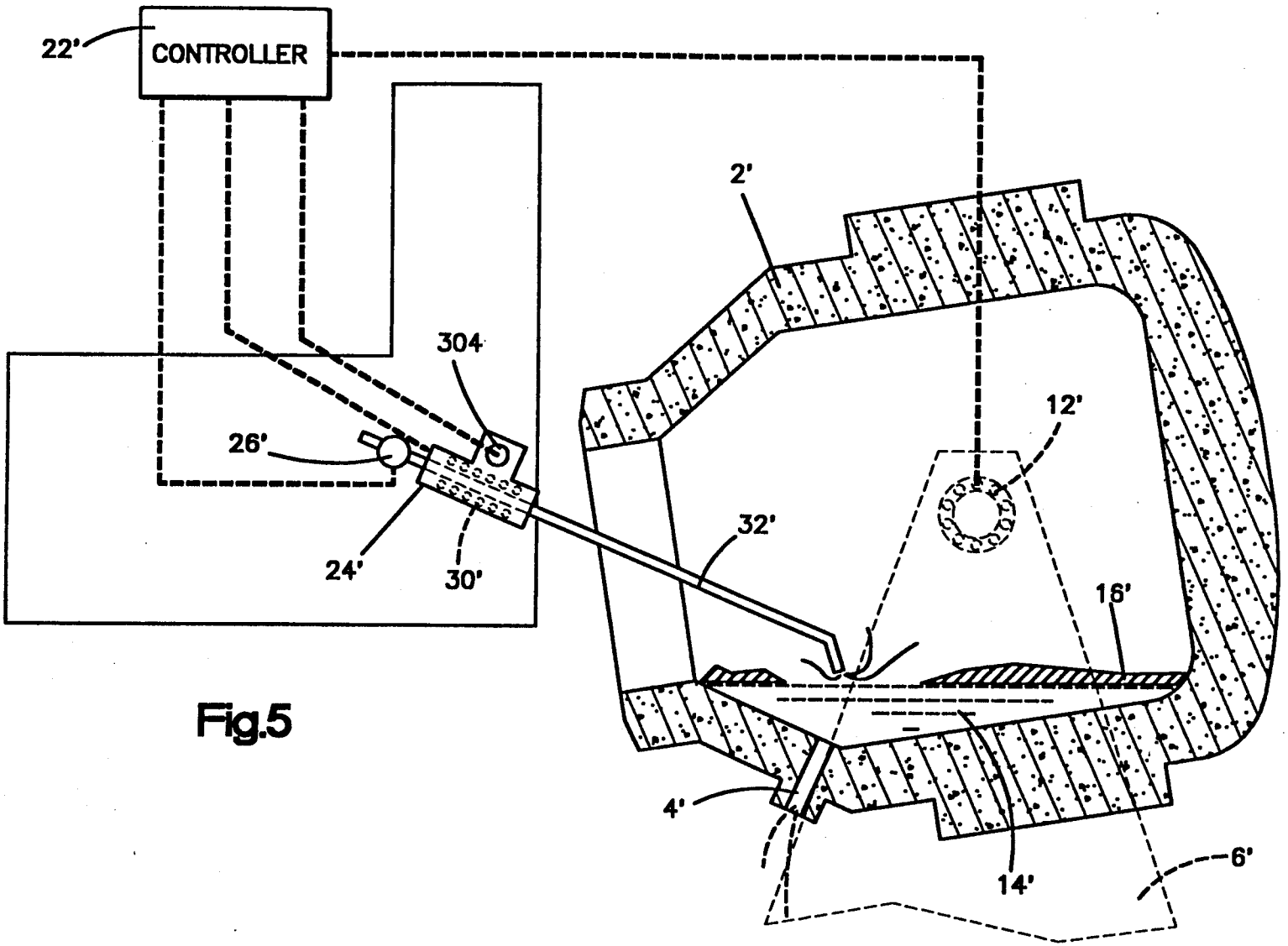
FIG. 5 is a side elevational view of the present invention as applied to a BOF apparatus in a second tapping orientation.

Initially, the depth of the bath 14' prevents slag 16' from being entrained in the vortex. However, as the volume of the bath 14' decreases, slag 16' is drawn into the vortex. The controller simultaneously regulates the gas control valve 26' to cause a stream of air to be projected through the lance 32' and onto the slag to prevent the slag from entering the vortex. Thereafter, as the volume of molten metal within the vessel 2' decreases, the vessel 2' attitude is adjusted to maximize the flow of metal through the tap hole 4'. The magnitude of the change in the vessel attitude may be controlled manually from the shop floor. When attitude is manually controlled, an individual on a platform or pulpit with a view of the bath within the vessel 2' signals a vessel operator to tilt the vessel a predetermined amount. The vessel operator responds by operating an attitude adjustment drive (not shown) to adjust the vessel attitude to the position shown in FIG. 5. As the attitude is altered, the controller 22' re-positions the lance 32' above the vortex, as shown in FIG. 5, to prevent slag from entering into the vortex or the tap hole 4'. Alternatively, the sensors means can be equipped with load cells (not shown) to monitor the weight of the vessel 2' so that the attitude adjustment of the vessel can be controlled by the controller 22' automatically once the tapping process is initiated. In this embodiment, once the composition and temperature of the bath 14' with in vessel 2' meets the tapping requirements, the controller 22' alters the attitude of the vessel 2' as shown in FIG. 4'. Throughout the tapping process, the controller 22' continuously monitors the weight of the vessel 2' through the load cells. Once the sensed weight is substantially equal to the volume of bath 14' associated with FIG. 5, the controller 22' automatically drives the attitude adjustment drive (not shown) to position the vessel 2' from the attitude associated with FIG. 4 to that of FIG. 5. When the vessel 2' weight indicates that the bath 14' has been substantially tapped, the controller 22' operatively drives the attitude adjustment drive to position the vessel 2' as shown in FIG. 3, thereby concluding the tapping process.

In operation, the vessel 2' is first charged with steel scrap, molten iron, iron ore (if needed) and fluxes such as burnt lime and fluorspar. The amounts of each of these materials are pre-determined by computer to meet the requirements of the ordered finished steel. The computer also calculates the amount of oxygen which will be blown into the vessel during a heat to create the finished steel.

The scrap steel is dumped into the vessel 2' first by tilting the vessel backwards towards a charging aisle on the shop floor. A charging machine or crane raises a scrap box and deposits the scrap into the empty vessel 2'. As soon as the charging machine is moved clear of the vessel 2', an overhead crane transports a hot metal ladle to the vessel 2' mouth and pours its charge of molten iron on top of the scrap. The vessel 2' is then returned to an upright position.

Generally, within three minutes an oxygen lance is lowered into the furnace. Once the flow of oxygen is started through the lance and onto/into the bath (herein referred to as the blow), the steel making process is underway (herein referred to as a heat). Moments after the blow is initiated, the oxygen reacts with the impurities of the charge. The fluxes are then added to the furnace through a flux chute located above the mouth of the furnace.

To determine when to terminate a heat, a vessel 2' operator withdraws the oxygen lance from the vessel 2' and tilts the vessel 2' backward toward the charging aisle once again. The temperature and a sample of the bath 14' are then taken. Chemical analysis is then performed on the sample to determine if the refining of the heat should continue. Additionally, if the temperature of the steel within the vessel 2' is too hot, the furnace is returned to the vertical position and limestone is charged into the mouth of the vessel 2' to act as a coolant. If the temperature of the steel is too low, the oxygen lance is again lowered into the vessel 2' and the blow is continued. This process continues until the steel within the vessel 2' meets the tapping requirements.

Once a heat is refined, the vessel operator initiates the tapping process by tilting the vessel 2' forwardly towards its tap hole 4' side. As the volume of steel bath 14' decreases during tapping, the vessel 2' is progressively titled farther forward, either manually or automatically as discussed above, to maximize the flow of molten steel from the vessel 2'. As the volume of molten steel within the vessel 2' decreases, slag 16' is drawn into the vortex.

As the vessel 2' is tilted forward, the controller 22', through sensor means 20' integrally attached to the support structure 6', continuously monitors the attitude and weight of the vessel 2'. As the attitude of the vessel 2' changes the controller 22' systematically and continuously operates the alignment drive 304 to position the extension drive 24' adjacent the vessel 2' mouth so that the drive mechanism 30' is correctly positioned to place and maintain the distal end of the lance 32' within the vessel 2' a predetermined distance above the tap hole 4' and slag covered surface 16'.

As the distal end of the lance 32' is properly positioned, the controller 22' generates a continuous gas valve control signal to regulate the flow of gas through the lance 32' onto the bath 14' surface.

The gas control valve 26' is interfaced with the controller 22' to receive the gas valve control signal and opens, closes or adjusts the valve 26' accordingly. Typically, valve 26' is maintained in an open orientation from the point wherein the slag covered surface 16' would normally begin to be drawn into the vortex.

When the sensed vessel 2' physical characteristics correspond to an empty vessel 2', the controller 22' concludes the tapping process by operatively directing a stream of gas onto the remaining slag 16' until the furnace operator adjusts the attitude of the vessel 2' such that slag 16' is prevented from entering the tap hole 4'. As the attitude is adjusted the drive mechanism 24' and the alignment drive 304 simultaneously receive signals representative of the sensed physical characteristics of the vessel 2' so that the position of the lance 32' is adjusted in a corresponding fashion. Once the vessel 2' attitude is such that no slag 16' will flow through the tap hole 4', the lance is withdrawn to its pre tapping position and the vessel 2' is righted as in FIG. 3. Alternatively, the regulation of the above BOF tapping process can be accomplished by mounting a slide gate mechanism 28, interfaced to the controller 22', (see FIG. 1) to the outside of the vessel 2' near the tap hole 4'. The slide gate mechanism 28' is opened by the controller 22' after the vessel attitude is adjusted for tapping as in FIG. 4. Moreover, as the vessel 2' attitude is adjusted to correspond with the attitude shown in FIG. 5, the slide gate 28' can be adjusted to regulate the flow of molten metal from the bath, if desired. Finally, once the bath 14' volume has been substantially tapped, the slide gate mechanism 28 is closed while the vessel 2' attitude corresponds to the attitude shown in FIG. 5. The vessel 2' attitude is then returned to the upright position as shown in FIG. 3.

The remaining slag 16' is then removed by tilting the vessel 2' backwardly towards the charging aisle to pour the remaining slag 16' into a slag pot or pit. From this slag discharge, the empty vessel 2' is turned to the charging position and is ready to receive its charge for the next heat.

Although the invention has been described with a certain degree of particularity, it should be understood that those skilled in the art can make various changes to it without departing from the spirit or scope as hereinafter claimed.

I claim:

1. In an apparatus for promoting the slag-free tapping of molten metal through a tap hole, the tap hole being located in a metallurgical vessel carried by a support structure, by directing a stream of gas onto a slag covered surface of molten metal, above the tap hole, to substantially clear the surface of slag, thereby impeding the slag from being entrained in the molten metal stream as it is tapped from the vessel, the improvement comprising:

a. a lance feeder means connected to the support structure for positioning a lance in the metallurgical vessel;

b. the lance being drivingly connected to said feeder means for insertion into the metallurgical vessel;

c. connecting means for connecting a substantially non-reactive gas source to the lance;

d. sensor means connected to the vessel to monitor the physical conditions of the vessel and its contents and emit vessel signals representative of said physical conditions; and e. control means interfaced with the sensor means the lance feeder means to control the positioning of a distal end of the lance over the slag covered surface above the tap hole and to control the flow of the non-reactive gas through the lance to force slag away from the surface of the metal near the tap hole whereby slag entrainment in the molten metal stream is minimized during tapping of the molten metal from the vessel.

2. The apparatus of claim 1 wherein the control means controls a tap hole control valve in response to said signals representative of said physical conditions thereby regulating the flow of molten metal through the tap hole.

3. The apparatus of claim 1 wherein the control means is a programmable controller.

4. The apparatus of claim 2 wherein the tap hole control valve is a slide gate.

5. An improved apparatus for promoting the slag free tapping of molten metal through a tap hole in a metallurgical vessel by directing a stream of gas onto a slag covered surface of molten metal above the tap hole to impede the slag from being entrained in the molten metal stream as it is tapped from the vessel, the improvement comprising:

a. support structure for carrying the vessel;

b. sensor means connected to the vessel to monitor the weight and orientation of the vessel and its contents and emit signals representative of the weight of the vessel and its contents and the orientation of the vessel;

c. lance feeder means connected to the support structure;

d. a lance drivingly connected to the feeder means and normally positioned by the feeder means near an opening in the vessel;

e. connection means for connecting a supply of gas to the lance;

f. the lance feeder means being adapted to move the lance from its normal position through the opening and into the metallurgical vessel; and, g. control means interfaced with the sensor means to receive the signals representative of the weight of the vessel and its contents, and the orientation of the vessel, and actuate the lance feeder means to position and maintain the distal end of the lance a predetermined distance from such slag covered molten metal surface, near the tap hole, and to regulate the flow of gas through the lance onto such slag covered molten metal surface to force the slag away from the surface of the metal near the tap hole as the tapping process nears completion whereby slag entrainment in the molten metal stream is minimized as the conclusion of a tapping operation is reached.

6. The apparatus of claim 5 wherein the control means controls a tap hole control valve in response to said signals representative of the weight of the vessel and its contents and the orientation of the vessel, to regulate the flow of molten metal through the tap hole.

7. The apparatus of claim 5 wherein the control means is a programmable logic controller.

8. The apparatus of claim 6 wherein the tap hole control valve is a slide gate.

9. An improved apparatus for promoting the slag free tapping of molten metal through a tap hole of a metallurgical vessel by directing a stream of gas above the tap hole and onto a slag covered surface of the molten metal to prevent such slag from being entrained in the molten metal stream as it is tapped from the vessel, the improvement comprising:

a. a vessel support structure connected to the vessel;

b. lance feeder means secured to said support structure for extending a lance into and retracting a lance from the metallurgical vessel;

c. the lance being mounted in driving relationship with said feeder means above the metallurgical vessel near the tap hole;

d. connection means to connect the lance to a supply of gas;

e. sensor means operatively secured to the vessel to monitor the physical characteristics of the vessel and emit signals representative of said physical characteristics;

f. control means interfaced with said sensor means to receive said signals representative of said physical characteristics and control the lance feeder means to position and maintain the distal end of the lance above the tap hole a predetermined distance from such slag covered surface of the molten metal and to control a lance gas valve to regulate the flow of gas through the lance in response to said signals representative of said physical characteristics.

10. The apparatus of claim 9 wherein the control means is a programmable logic controller.

11. The apparatus of claim 9 wherein the control means controls a tap hole control valve in response to said signals representative of said physical characteristics thereby regulating the flow of molten metal through the tap hole.

12. The apparatus of claim 11 wherein the tap hole control valve is a slide gate.

13. An apparatus for promoting slag free tapping of slag covered molten metal through a tap hole of a vessel, the improvement comprising:

a. support means for supporting said vessel, said support means including sensor means to monitor the weight of the vessel and emit a vessel signal representative of said weight;

b. a lance adapted to be connected to a gas source, the lance having a nozzle at its distal end, the lance being positioned to extend into said vessel;

c. lance feeder means connected to the support means and drivingly connected to the lance and having at least one drive mechanism to pass the distal end of the lance into the vessel and locate and maintain the distal end in a position near the tap hole a predetermined distance above such slag covered molten metal surface;

e. a computerized controller interfaced with the sensor means to receive the vessel signal and interfaced with the lance feeder means in controlling relationship;

f. said controller generating a lance positioning control signal for actuating the drive mechanism to position and maintain the lance nozzle said predetermined distance above the molten metal, and g. said controller controlling a gas control valve connected to the lance, to regulate the flow of the gas through the lance.

14. The apparatus of claim 13 wherein said controller controls a tap hole valve to regulate the flow of molten metal through said tap hole.

15. The apparatus of claim 13 wherein said vessel includes a cover having an aperture substantially above said tap hole and wherein said lance passes through said aperture when in said position.

16. The apparatus of claims 13 wherein the tap hole control valve is a slide gate.

17. An apparatus for promoting slag free tapping of molten metal through a tap hole of a metallurgical vessel having a mouth portion therein, comprising:

a. vessel support structure for supporting and manipulating the vessel;

b. sensor means operatively connected to the vessel to monitor the attitude and the weight of the vessel;

c. the sensor means emitting signals representative of said attitude and weight of the vessel;

d. a computerized controller interfaced with the sensor means, said controller receiving said signals from said sensor means and generating at least one alignment signal and at least one lance position signal;

e. a lance feeder means interfaced with said computerized controller and having an alignment drive and an extension drive;

f. a lance secured in driving relationship to said extension drive and adapted to be connected to a gas source;

g. the alignment drive being adapted to receive said alignment signal and align said extension drive adjacent the mouth portion of the vessel; and, h. the extension drive being adapted to receive said lance position signal and position the lance within the vessel over the tap hole.

18. The apparatus of claim 17 wherein the computerized controller operatively controls a lance gas valve to regulate the flow of the gas into the lance in response to said signals representative of said attitude and weight of the vessel.

19. The apparatus of claim 17 wherein the computerized controller operatively controls the extension drive and alignment drive to inhibit the inclusion of slag in the molten metal drawn through the tap hole, and to regulate the flow of molten metal through the tap hole in response to said signals representative of said attitude and weight of the vessel.

20. A method of promoting slag free tapping of molten metal from a metallurgical vessel containing molten metal and a superimposed layer of slag, comprising the steps of:

a. opening a tap hole in the metallurgical vessel;

b. draining the molten metal through the tap hole;

c. monitoring the physical characteristics of said vessel;

d. emitting an alignment signal, a gas control valve signal and a tap hole valve signal in response to said physical characteristics;

e. positioning and maintaining a lance in a predetermined position within the vessel over the superimposed layer of slag above the tap hole in response to said alignment signal;

f. regulating a gas control valve to direct a gas through said lance and onto the surface of said molten metal and slag in response to said gas control valve signal; and g. regulating a tap hole control valve to control the flow of molten metal through the tap hole in response to said tap hole valve signal.

21. The method of claim 20 wherein the step of monitoring the physical characteristics of said vessel is carried out by computerized sensing means, said sensing means emitting said alignment signal, gas control valve signal and tap hole valve signal.

22. The method of claim 20 wherein the step of placing the lance in a predetermined position is carried out by a computer interfaced feeder apparatus in response to said alignment signal and wherein said lance is drivingly connected to said feeder apparatus.

23. A method of promoting slag free tapping of molten metal comprising the steps of:

a. monitoring the physical characteristics of a vessel containing molten metal and a superimposed layer of slag;

b. emitting an attitude signal, an alignment signal, and a gas control valve signal in response to said physical characteristics;

c. adjusting the attitude of said vessel containing molten metal and a superimposed layer of slag in response to said attitude signal;

d. positioning a lance in a predetermined position above the tap hole and within the vessel in response to said alignment signal;

e. regulating a gas control valve to direct a gas through said lance and onto the surface of said molten metal and slag in response to said gas control valve signal;

f. draining the molten metal through the tap hole; and g. regulating the flow of molten metal through the tap hole in response to said physical characteristics.

24. The method of claim 23 further characterized in that the step of regulating the flow of molten metal through the tap hole is carried out by adjusting the attitude of said vessel in response to said physical characteristics.

25. An apparatus for promoting slag free tapping of molten metal through a tap hole of a metallurgical vessel having a mouth opening portion, comprising:

a. vessel support structure for supporting and manipulating the vessel;

b. sensor means operatively connected to the vessel to monitor the attitude of the vessel;

c. the sensor means emitting signals representative of said attitude of the vessel;

d. a computerized controller interfaced with the sensor means, said controller receiving said signals from said sensor means and generating at least one alignment signal and at least one lance position signal;

e. a lance feeder means interfaced with said computerized controller and having an alignment drive and an extension drive;

f. a lance secured in driving relationship to said extension drive and adapted to be connected to a gas source;

g. the alignment drive being adapted to receive said alignment signal and align said extension drive near the mouth opening portion of the vessel; and, h. the extension drive being adapted to receive said lance position signal and position the lance within the vessel over the tap hole.

26. A method of promoting slag free tapping of molten metal comprising the steps of:

a. opening a tap hole in the base of a vessel containing molten metal and a superimposed layer of slag;

b. draining the molten metal through the tap hole;

c. monitoring the physical characteristics of said vessel;

d. positioning and maintaining a lance in a predetermined position within the vessel above the super imposed layer of slag and the tap hole in response to said physical characteristics of said vessel;

e. directing a stream of non-reactive gas through said lance and onto the surface of said molten metal and slag in response to said physical characteristics; and f. regulating the flow of molten metal through the tap hole in response to said physical characteristics.

27. The method of claim 26 wherein step d. is further characterized by continuously repositioning and maintaining the distal end of the lance in a predetermined position above the superimposed layer of slag and the tap hole of the vessel as the volume in the bath decreases during the tapping process.

28. An apparatus for promoting slag free tapping of molten metal, comprising:

a. a metallurgical vessel having a tap hole and a mouth portion therein;

b. vessel support structure for supporting and manipulating the vessel;

c. sensor means operatively connected to the vessel to monitor the attitude and the weight of the vessel;

d. the sensor means emitting signals representative of said attitude and weight of the vessel;

e. a computerized controller interfaced with the sensor means, said controller receiving said signals from said sensor means and generating at least one alignment signal and at least one lance position signal;

f. a lance feeder means interfaced with said computerized controller and having an alignment drive and an extension drive;

g. a lance secured in driving relationship to said extension drive and adapted to be connected to a gas source;

h. the alignment drive being adapted to receive said alignment signal and align said extension drive adjacent the mouth portion of the vessel; and i. the extension drive being adapted to receive said lance position signal and position the lance within the vessel near the tap hole.

* * * * *